US009605370B2

(12) United States Patent
Kim et al.

(10) Patent No.: US 9,605,370 B2
(45) **Date of Patent: *Mar. 28, 2017**

(54) WASHING MACHINE HAVING DUAL-DRUM AND ASSEMBLY METHOD THEREOF

(71) Applicant: LG ELECTRONICS INC., Seoul (KR)

(72) Inventors: Jinwoong Kim, Seoul (KR); Kyeonghwan Kim, Seoul (KR); Hyunseok Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/430,070

(22) PCT Filed: Oct. 8, 2013

(86) PCT No.: PCT/KR2013/008991

§ 371 (c)(1),
(2) Date: Mar. 20, 2015

(87) PCT Pub. No.: WO2014/058212

PCT Pub. Date: Apr. 17, 2014

(65) Prior Publication Data

US 2015/0225885 A1 Aug. 13, 2015

(30) Foreign Application Priority Data

Oct. 9, 2012 (KR) ..... 10-2012-0112047

(51) Int. Cl.
*D06F 37/30* (2006.01)
*D06F 37/04* (2006.01)
(Continued)

(52) U.S. Cl.
CPC ..... *D06F 37/30* (2013.01); *D06F 37/00* (2013.01); *D06F 37/04* (2013.01); *D06F 37/06* (2013.01);
(Continued)

(58) Field of Classification Search
CPC ..... D06F 37/04; D06F 37/06; D06F 37/30; D06F 37/00; D06F 37/269; D06F 31/00; Y10T 29/49826
See application file for complete search history.

(56) References Cited

U.S. PATENT DOCUMENTS

2004/0010369 A1 1/2004 Linstrom et al.
2004/0035155 A1 2/2004 Yoon
(Continued)

FOREIGN PATENT DOCUMENTS

CA 2 332 024 A1 11/1999
CN 1170059 A 1/1998
(Continued)

*Primary Examiner* — Michal Barr
*Assistant Examiner* — Benjamin L Osterhout
(74) *Attorney, Agent, or Firm* — Dentons US LLP

(57) ABSTRACT

Disclosed are a washing machine having a dual-drum of a main drum and a sub drum, and an assembly method thereof. The washing machine comprises: a cabinet; a tub provided in the cabinet; a main drum rotatably mounted in the tub; a sub drum mounted in the main drum so as to perform a relative rotation with the main drum; a hollow type outer shaft connected to the main drum; an inner shaft connected to the sub drum in the outer shaft; and a driving motor, wherein the driving motor comprises: a stator; an outer rotor connected to the inner shaft, and rotated outside the stator; and an inner rotor connected to the outer shaft, and rotated inside the stator, and wherein the driving motor drives the main drum and the sub drum in an independent manner.

13 Claims, 4 Drawing Sheets

(51) Int. Cl.

| | |
|---|---|
| ***D06F 37/26*** | (2006.01) |
| ***D06F 37/06*** | (2006.01) |
| ***D06F 37/00*** | (2006.01) |
| *D06F 31/00* | (2006.01) |

(52) U.S. Cl.
CPC ..... *D06F 37/269* (2013.01); *D06F 31/00* (2013.01); *Y10T 29/49826* (2015.01)

(56) References Cited

U.S. PATENT DOCUMENTS

| | | | | |
|---|---|---|---|---|
| 2004/0163429 | A1 | 8/2004 | Lim | |
| 2005/0229651 | A1* | 10/2005 | Ahn | D06F 37/04 68/139 |
| 2006/0042022 | A1 | 3/2006 | Kim et al. | |
| 2006/0254321 | A1* | 11/2006 | Lim | D06F 37/225 68/12.01 |
| 2007/0125135 | A1* | 6/2007 | Kim | D06F 37/304 68/140 |
| 2008/0024018 | A1 | 1/2008 | Rignault et al. | |
| 2009/0133447 | A1* | 5/2009 | Yoon | D06F 37/02 68/23.1 |
| 2010/0018257 | A1 | 1/2010 | Chang | |
| 2011/0099731 | A1* | 5/2011 | Im | D06F 33/02 8/137 |
| 2012/0011900 | A1* | 1/2012 | Kwon | D06F 37/20 68/140 |

FOREIGN PATENT DOCUMENTS

| | | | |
|---|---|---|---|
| CN | 2305416 | Y | 1/1999 |
| CN | 1212302 | A | 3/1999 |
| CN | 1427112 | A | 7/2003 |
| CN | 1469949 | A | 1/2004 |
| CN | 1531611 | A | 9/2004 |
| CN | 1743535 | A | 3/2006 |
| CN | 1880563 | A | 12/2006 |
| CN | 101074527 | A | 11/2007 |
| CN | 101074535 | A | 11/2007 |
| CN | 101171382 | A | 4/2008 |
| CN | 101177879 | A | 5/2008 |
| CN | 101314905 | A | 12/2008 |
| CN | 201339116 | Y | 11/2009 |
| CN | 101632213 | A | 1/2010 |
| CN | 102208854 | A | 10/2011 |
| EP | 0688894 | A1 | 12/1995 |
| EP | 0947622 | A2 | 10/1999 |
| EP | 1630278 | A2 | 3/2006 |
| EP | 1967636 | A1 | 9/2008 |
| GB | 2141742 | A | 1/1985 |
| GB | 2314093 | A | 12/1997 |
| GB | 2368071 | A | 4/2002 |
| JP | 03-111089 | A | 5/1991 |
| JP | 06-038413 | A | 2/1994 |
| JP | 11-137884 | A | 5/1999 |
| JP | 2002-514488 | A | 5/2002 |
| JP | 2003-299296 | A | 10/2003 |
| JP | 2004-72949 | A | 3/2004 |
| JP | 2005-110485 | A | 4/2005 |
| JP | 2006-43153 | A | 2/2006 |
| JP | 2006230956 | A | 9/2006 |
| JP | 2007-318974 | A | 12/2007 |
| JP | 2007318974 | A | 12/2007 |
| JP | 2010-46323 | A | 3/2010 |
| KR | 10-2006-0088237 | A | 8/2006 |
| RU | 2002119569 | A | 2/2004 |
| SU | 1758785 | A1 | 8/1992 |
| WO | 2006-126814 | A2 | 11/2006 |
| WO | 2010/008181 | A2 | 1/2010 |

* cited by examiner

WASHING MACHINE HAVING DUAL-DRUM AND ASSEMBLY METHOD THEREOF

This application is a 35 USC §371 National Stage entry of International Application No. PCT/KR2013/008991 filed on Oct. 8, 2013, which claims priority to Korean Application No. 10-2012-0112047, filed on Oct. 9, 2012, each of which is hereby incorporated by reference in its entirety.

TECHNICAL FIELD

The present invention relates to a washing machine having a dual-drum of a main drum and a sub drum, and more particularly, to a sub drum capable of enhancing a coupling structure with a sub drum spider, capable of increasing an inner capacity thereof, and capable of improving roundness and an assembly structure, a washing machine having the sub drum and a main drum, and an assembly method thereof.

BACKGROUND ART

Generally, a washing machine serves to forcibly move laundry inside a drum which rotates by receiving a driving force of a driving motor, using a mechanical force such as a frictional force between the drum and the laundry, in a state where a detergent, washing water and the laundry have been introduced into the drum. As the laundry receives a physical force such as friction or impact, a washing operation is performed. The washing operation may be performed by a chemical reaction through a contact between the laundry and the detergent. The chemical reaction of the detergent may be accelerated as the laundry moves in the drum.

In a drum type washing machine much used recently, a rotation shaft of a drum is formed in a horizontal direction. The rotation shaft of the drum may be inclined from the horizontal direction. In such drum type washing machine where the rotation shaft is formed in a horizontal direction, laundry moves in a circumferential direction along an inner circumferential surface of the drum.

Laundry moves along the inner circumferential surface of the drum by a centrifugal force due to rotation of the drum, and by friction with the inner circumferential surface of the drum. A lifter, configured to help such movement of the laundry, may be provided on the inner circumferential surface of the drum. According to a rotation speed of the drum, the laundry may perform a circular motion along the inner circumferential surface of the drum, or may perform a falling motion from an upper side of the drum by gravity. Such falling motion greatly influences on a washing effect.

Movement of the laundry in the drum greatly influences on a washing effect. More specifically, various movements of the laundry result in a uniform washing operation by changing contact surfaces between the laundry and the inner circumferential surface of the drum. Further, a washing effect can be enhanced by increasing a physical force applied to the laundry.

In the conventional drum type washing machine, a single drum is rotated to move laundry. The laundry can move only in a circumferential direction of the drum along the inner circumferential surface of the drum on the initial position. That is, the laundry cannot perform a complicated movement such as a movement in a shaft direction or a rotation movement. The laundry can perform only a 2D movement. The reason is because an additional external force to generate a complicated movement of the laundry is not generated. Under such configuration, the movement of the laundry is limited, and thus the washing effect is limited. Further, a washing time (duration) and power consumption are increased.

DISCLOSURE OF INVENTION

Technical Problem

Therefore, an object of the present invention is to provide a dual-drum washing machine capable of enhancing roundness and durability, and capable of reducing the material cost by improving a sub drum, and an assembly method thereof.

Another object of the present invention is to provide a dual-drum washing machine capable of enhancing a coupling structure between a sub drum and a sub drum spider, of increasing an inner capacity of the sub drum, and of facilitating an operation to process dehydration holes and patterns, and an assembly method thereof.

Solution to Problem

To achieve these and other advantages and in accordance with the purpose of the present invention, as embodied and broadly described herein, there is provided a washing machine having a dual-drum, comprising: a cabinet which forms an appearance of the washing machine; a tub provided in the cabinet; a main drum rotatably mounted in the tub; a sub drum mounted in the main drum so as to perform a relative rotation with the main drum; a hollow type outer shaft connected to the main drum; an inner shaft connected to the sub drum in the outer shaft; a main drum spider configured to connect the main drum and the outer shaft to each other; a sub drum spider configured to connect the sub drum and the inner shaft to each other; and a driving motor.

The driving motor may include: a stator; an outer rotor connected to the inner shaft, and rotated outside the stator; and an inner rotor connected to the outer shaft, and rotated inside the stator. Under such configuration, the main drum and the sub drum can be rotated in an independent manner.

The sub drum may include: a cylindrical portion which forms an outer circumferential surface of the sub drum; and a sub drum back which forms a rear surface of the sub drum, and to which the sub drum spider is coupled. The sub drum back may include an accommodation portion forward-concaved from the sub drum back and configured to accommodate the sub drum spider at a rear side thereof.

The sub drum spider may be provided with a plurality of cantilevers radially extending from the inner shaft, and may be coupled to the sub drum back.

According to another embodiment of the present invention, the sub drum may be a single member where the cylindrical portion and the sub drum back have been integrated with each other.

The accommodation portion may be provided with coupling holes for coupling the sub drum spider thereto. The coupling holes formed at the accommodation portion may be adjacent to an end of the accommodation portion in a radius direction. And the accommodation portion may be formed at an inner side of the sub drum back by being spaced from an outer circumference of the sub drum back. The sub drum spider may be provided with coupling holes corresponding to the coupling holes of the accommodation portion. The cantilevers of the sub drum spider may be formed such that a length thereof is smaller than a radius of the sub drum back so as to be accommodated in the accommodation portion.

According to another embodiment of the present invention, the cylindrical portion and the sub drum back of the sub drum may be configured as independent members. The sub drum back may be coupled to an outer circumference of the rear of the cylindrical portion to close a rear side opening of the cylindrical portion.

The accommodation portion of the sub drum back may be extending up to an outer circumference of the sub drum back.

The cylindrical portion may include sub drum back coupling holes formed at a rear end thereof. And the sub drum back may include a bending portion formed as an outer circumference of the sub drum back is bent in a lengthwise direction of the sub drum, and cylindrical portion coupling holes formed at the bending portion.

The sub drum spider may be formed such that its cantilevers are extending up to the outer circumference of the sub drum back, and each end of the cantilevers of the sub drum spider may be coupled to the sub drum back on an outer circumference of a rear surface of the cylindrical portion.

To achieve these and other advantages and in accordance with the purpose of the present invention, as embodied and broadly described herein, there is also provided an assembly method of a washing machine, the method comprising: forming a rear surface of a sub drum; and coupling the sub drum spider with the rear surface of the sub drum.

The sub drum may be driven independently from a main drum rotatably disposed in a tub fixed to a cabinet, and may be rotatably disposed in the main drum.

The step of forming the rear surface of the sub drum may include covering a rear side opening of a cylindrical portion which forms an outer circumference of the sub drum, with a sub drum back which forms the rear surface of the sub drum.

The sub drum back may include an accommodation portion forward-concaved from the sub drum back.

The step of coupling the sub drum spider to the rear surface of the sub drum may include: accommodating the sub drum spider into an accommodation portion forward-concaved from the sub drum back; and coupling the sub drum spider to the sub drum back via bolts.

In the step of coupling the sub drum spider to the sub drum back via bolts, the sub drum spider may be coupled to the sub drum back through coupling holes formed at a rear end of the cylindrical portion of the sub drum, and coupling holes formed at a bending portion of the sub drum back.

Advantageous Effects of Invention

The present invention can have the following advantages.

According to an embodiment, the sub drum of the dual-drum washing machine can be formed as an integrated type. This can allow roundness and durability to be enhanced, and the material cost to be reduced.

According to another embodiment, a coupling structure between the sub drum spider and the sub drum back can be enhanced as the cylindrical portion of the sub drum and the sub drum back are adopted in an independent manner. An inner capacity of the drum can be increased. Further, an operation to process dehydration holes and patterns can be facilitated.

BRIEF DESCRIPTION OF DRAWINGS

FIG. 2 is an exploded perspective view of a main drum, a sub drum and so on;

MODE FOR THE INVENTION

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a washing machine having a dual-drum and an assembly method thereof according to embodiments, with reference to the accompanying drawings.

Figure 1:
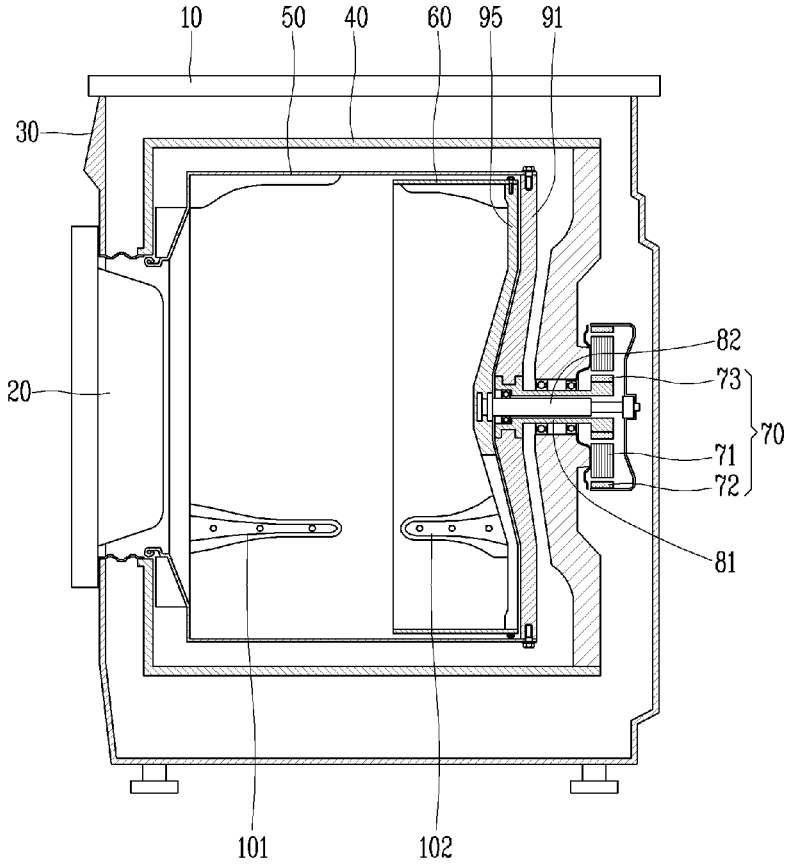
FIG. 1 is a schematic diagram of a washing machine according to an embodiment of the present invention.

FIG. 1 is a schematic diagram of a washing machine according to an embodiment of the present invention.

Referring to FIG. 1, the washing machine according to an embodiment comprises a cabinet 10 forming the appearance of the washing machine. An introduction opening 20, through which laundry, an object to be cleaned is introduced into the cabinet 10, is formed on a front surface of the cabinet 10.

The introduction opening 20 is open and closed by a door rotatably fixed to a cabinet. A control panel 30, having various types of manipulation buttons for manipulating the washing machine, is disposed above the introduction opening. A detergent supply device (not shown), configured to supply a detergent, etc., is provided at one side of the control panel 30.

A tub 40 of a cylindrical shape, a main drum 50 and a sub drum 60 are provided at an accommodation space in the cabinet 10. The tub 40 is configured to store therein washing water. The main drum 50 and the sub drum 60 are rotatably installed in the tub 40, and laundry is introduced thereinto. A driving motor 70, configured to drive the main drum and the sub drum, is provided at a rear side of the tub 40.

The tub 40 of a cylindrical shape can accommodate therein the main drum 50 and the sub drum 60. A front surface of the tub 40 is open so as to be connected to the open introduction opening 20 of the cabinet. Accordingly, a gasket, which encloses the front surface of the tub 40 and the introduction opening of the cabinet, is provided between the front surface of the tub and the introduction opening of the cabinet. Such configuration is implemented in order to prevent washing water in the tub 40 from being introduced into the cabinet.

The main drum 50 of a cylindrical shape is rotatably mounted in the tub 40. A plurality of through holes, through which washing water is discharged out, may be formed on side surfaces of the main drum 50.

The sub drum 60 of a cylindrical shape is rotatably mounted in the main drum 50. The sub drum 60 is mounted so as to perform a relative rotation with the main drum. That is, as the main drum and the sub drum can be driven in an independent manner, various relative rotations can be implemented according to a rotation speed and a rotation direction of the drums.

The driving motor 70, a device configured to generate a driving force for driving the main drum and the sub drum, is mounted on a rear surface of the tub 40. The driving motor 70 includes a stator 71, an outer rotor 72 rotated outside the stator, and an inner rotor 73 rotated inside the stator. The driving motor having such two rotors is called a dual-rotor motor.

Figure 4:
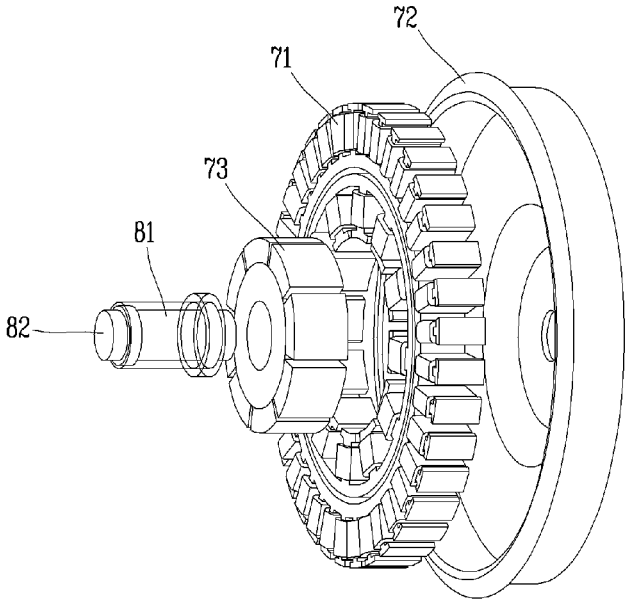
FIG. 4 is an exploded perspective view of a driving motor.

FIG. 4 is a detailed view of the driving motor 7. Referring to FIG. 4, the stator 71 has a ring shape to enclose the inner rotor 73, and is fixed to the tub 40. The stator is provided with an inner winding portion and an outer winding portion each having stator teeth formed on a core.

Figure 5:
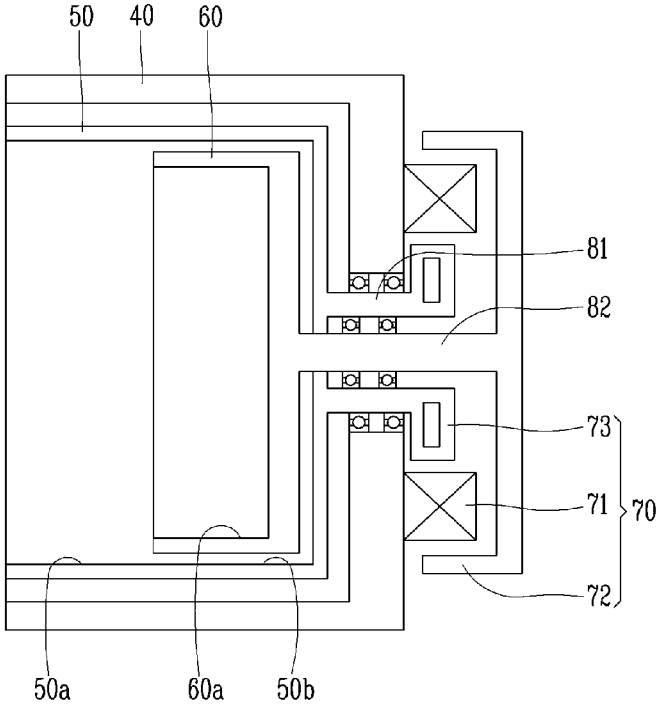
FIG. 5 is a schematic diagram illustrating a connected state among the driving motor, the main drum and the sub drum.

FIG. 5 is a schematic diagram illustrating a structure to transmit a driving force to the main drum and the sub drum by the driving motor. Referring to FIGS. 4 and 5, the inner rotor 73 is rotatably provided inside the stator, and is connected to an outer shaft 81 to be explained later to thus rotate the main drum 50. The outer rotor 72 is rotatably provided outside the stator, and is connected to an inner shaft 82 to be explained later to thus rotate the sub drum 60. The inner rotor and the outer rotor are provided with a magnet, respectively. Once a current flows to the inner winding portion and the outer winding portion of the driving motor, a magnetic field is generated by the current. As a result, the inner rotor and the outer rotor are rotated.

If a current flowing to coils wound on the inner winding portion and the outer winding portion of the driving motor 70 is controlled, the inner rotor and the outer rotor are rotated in an independent manner. As a result, as shown in FIG. 5, the main drum 50 and the sub drum 60 can be rotated in an independent manner by the single driving motor 70. That is, the driving motor serves to drive the main drum and the sub drum in an independent manner.

Such configuration is implemented to independently drive the main drum and the sub drum by the driving motor, and to make laundry rotate by a speed difference between relative rotations of the two drums. Under such configuration, laundry is rotated in the drum with 3D motions.

Figure 2:
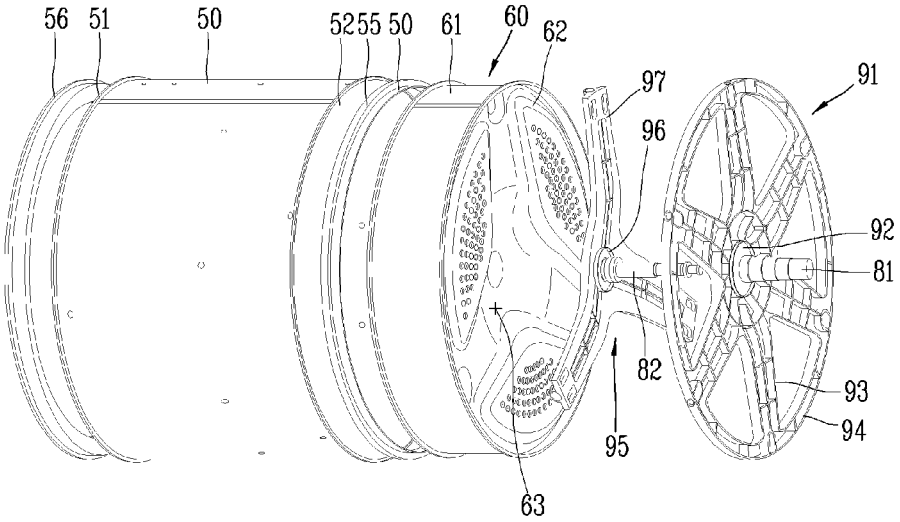
Figure 3:
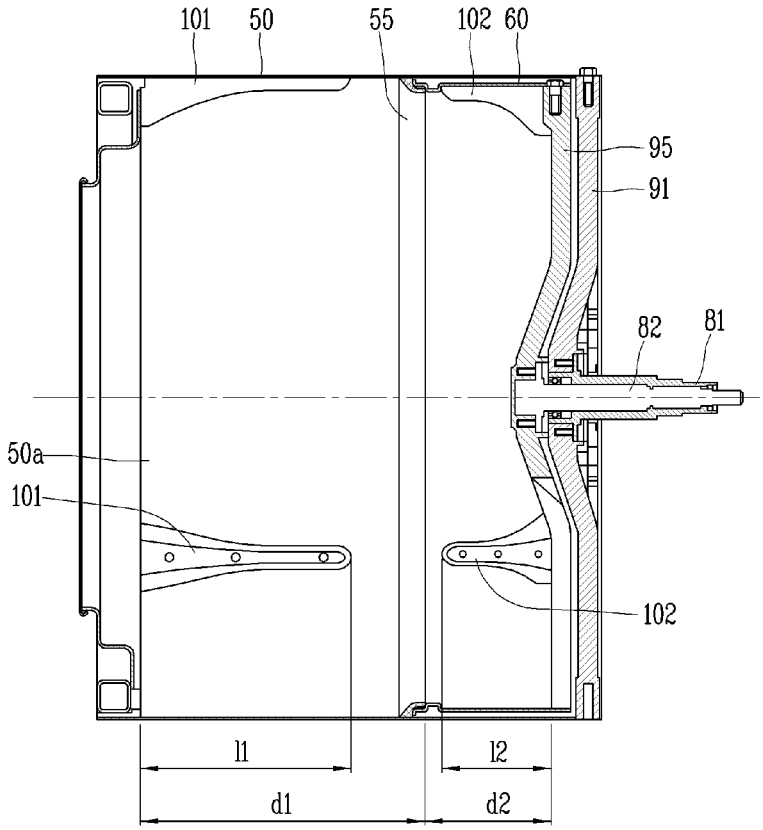
FIG. 3 is a view illustrating a coupled state among the main drum, the sub drum, and so on of FIG. 2.

FIGS. 2 and 3 are views illustrating that the main drum and the sub drum are coupled to shafts. Referring to FIGS. 2 and 3, the outer shaft 81 serves to connect the inner rotor 73 and the main drum 50 with each other through the tub 40. The outer shaft 81 is a hollow type shaft, and the inner shaft 82 is mounted to inside of the outer shaft 81. The inner shaft 82 serves to connect the outer rotor 72 and the sub drum 60 to each other through inside of the outer shaft 81.

The main drum 50 and the outer shaft 81 are connected to each other by a main drum spider 91. Referring to FIG. 2, a front surface 51 and a rear surface 52 of the main drum 50 are open. A drum guide 55 may be provided along the inner circumferential surface of the main drum and seal the interval from the outer circumferential surface of the sub drum. This is for preventing the laundry from being jammed between the main drum and the sub drum. A balancer 56 for preventing vibration and an eccentric state of the drum may be provided at the front surface 51 of the main drum. The main drum spider 91 is coupled to the outer shaft 81, and is fixed to the main drum 50.

Referring to FIG. 2, the main drum spider 91 includes an outer shaft coupling portion 92 coupled to the outer shaft 81, a main drum spider supporting portion radially extending from the outer shaft coupling portion 92, and a main drum fixing portion 94 provided at an end of the spider supporting portions. The main drum fixing portion 94 is coupled to the main drum 50.

The outer shaft coupling portion 92 is formed at a central portion of the main drum spider 91, and is provided with coupling holes to which the outer shaft 81 is coupled. The main drum spider supporting portion is configured as a plurality of cantilevers 93 radially extending from the central portion of the main drum spider 91. The main drum fixing portion 94 is configured as a ring which connects the respective ends of the plurality of cantilevers 93 of the main drum spider supporting portion to each other. The main drum spider supporting portion is configured to support the main drum spider, so that a driving force of the outer shaft 81 can be transmitted to the main drum through the main drum spider. In a modified embodiment, the main drum spider supporting portion may be configured as a disc extending from the outer shaft coupling portion 92.

The main drum spider 91 is coupled to an outer circumferential surface of the main drum. That is, the main drum fixing portion of a ring shape is coupled to the end of the outer circumferential surface of the main drum. The outer circumferential surface of the main drum may be coupled to the main drum fixing portion 94 by welding or via screws.

The sub drum 60 and the inner shaft 82 are connected to each other by a sub drum spider 95. Referring to FIG. 2, the sub drum 60 includes a sub drum back 62 which forms a rear surface of the sub drum 60. A front surface of the sub drum 60 is open, whereas a rear surface of the sub drum 60 is closed by the sub drum back 62. The sub drum spider 95 is fixed to the sub drum back 62 in an adhered manner.

The sub drum spider 95 includes an inner shaft coupling portion 96 coupled to the inner shaft 82, and a sub drum fixing portion having a plurality of cantilevers 97 radially extending from the inner shaft coupling portion 96.

Each end of the cantilevers 97 of the sub drum fixing portion is fixed to the sub drum back 62. The sub drum back 62 further includes an accommodation portion 63 inward-concaved from the sub drum back in correspondence to a shape of the sub drum spider. The sub drum spider 95 is accommodated in the accommodation portion 63, thereby being adhered to the sub drum back 62. The cantilevers 97 of the sub drum fixing portion and the sub drum back 62 may be coupled to each other by welding or via screws.

Referring to FIGS. 2 and 3, the sub drum spider 95 is provided between the sub drum back 62 and the main drum spider 91. The sub drum spider 95 is rotated together with the sub drum back 62, and is rotated independently from the main drum spider 91.

As the sub drum spider 95 rotates independently from the main drum spider 91, the main drum 50 and the sub drum 60 can rotate independently from each other. The aforementioned configurations provide a washing machine where the main drum and the sub drum are independently driven by the driving motor using additional spiders.

Referring to FIG. 5, the outer shaft 81 and the inner shaft 82 are configured to be rotatable independently in a state where a bearing is disposed therebetween. The outer rotor 72 and the inner rotor 73 are also configured to be rotatable independently in a state where the stator 71 is disposed therebetween. The stator 71 is provided with winding portions at an outer rotor side and an inner rotor side, and the driving motor can independently drive the outer rotor 72 and the inner rotor 73. Since the main drum 50 is driven by the inner rotor 73 and the sub drum 60 is driven by the outer rotor 72, the main drum and the sub drum can be independently driven by the driving motor.

As the outer rotor and the inner rotor are independently driven, the main drum and the sub drum can perform a relative rotation in various manners. That is, the main drum and the sub drum can perform a relative rotation in different rotation directions. Alternatively, the main drum and the sub drum can perform a relative rotation at different speeds in the same rotation direction.

Referring to FIG. 1, a plurality of main drum lifters 101 are protruding from an inner circumferential surface of the main drum toward the inside in a radial direction, and a plurality of sub drum lifters 102 are protruding from an inner circumferential surface of the sub drum toward the inside in a radial direction. This may allow laundry to smoothly move in the drum.

An inner circumferential surface of the main drum may be divided into a first surface 50*a* not facing an outer circumferential surface of the sub drum, and a second surface 50*b* facing the outer circumferential surface of the sub drum. The main drum lifters 101 are provided on the first surface 50*a*. The main drum lifters 101 may be disposed with the same interval therebetween along an inner circumferential surface of the main drum. And, the sub drum lifters 102 may be disposed with the same interval therebetween along an inner circumferential surface of the sub drum. A plurality of lifters are provided on the inner circumferential surface of the drum so that laundry inside the drum may perform 3D motions.

A length ratio of the main drum lifters 101 and the sub drum lifters 102 in an axial direction may be proportional to a length of the first surface 50*a* of an inner circumferential surface of the main drum, and a length of an inner circumferential surface 60*a* of the sub drum. Referring to FIG. 3, a length of the main drum lifters 101 in an axial direction may be defined as '11', a length of the sub drum lifters 102 in an axial direction may be defined as '12', a length of the first surface 50*a* of the inner circumferential surface of the main drum may be defined as 'd1', and a length of the inner circumferential surface 60*a* of the sub drum may be defined as 'd2'. In this case, a ratio of 11:12 may be proportional to a ratio of d1:d2. This is in order to respectively provide the lifters at the main drum and the sub drum having different lengths in an axial direction, and to allow the lifters to effectively contact laundry.

Referring to FIG. 3, the main drum lifters 101 and the sub drum lifters 102 are provided in the drum in parallel with an axial direction. However, the present disclosure is not limited to this. For instance, the main drum lifters and the sub drum lifters may be disposed with a predetermined angle from an axial direction.

Hereinafter, the sub drum and an assembly method thereof according to the present invention will be explained in more detail with reference to FIGS. 6 to 9.

The sub drum includes a cylindrical portion which forms an outer circumferential portion; and a sub drum back which forms a rear surface of the sub drum, and to which the sub drum spider is coupled. The sub drum back includes an accommodation portion forward-concaved from the sub drum back and configured to accommodate the sub drum spider on a rear surface of the sub drum back.

As aforementioned, the sub drum spider is provided with the sub drum fixing portion having the plurality of cantilevers 97 radially extending from the inner shaft, and is coupled to the sub drum back.

Figure 6:
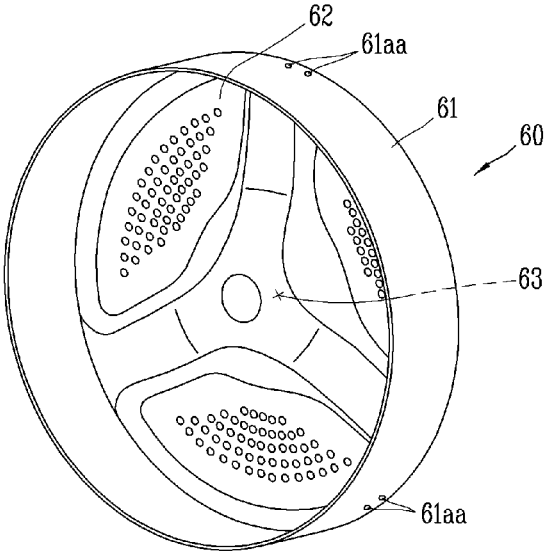
FIG. 6 is a front perspective view of a sub drum according to an embodiment of the present invention.
Figure 7:
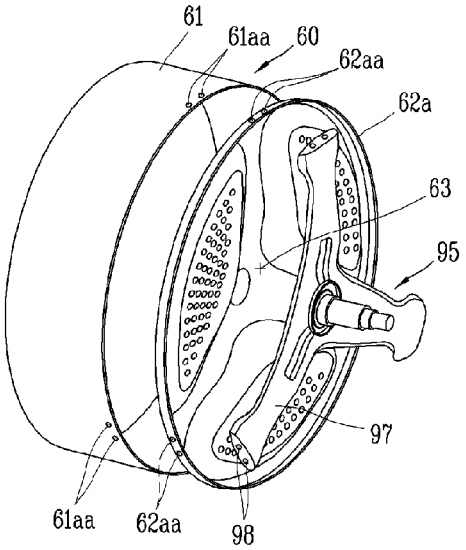
FIG. 7 is a rear exploded perspective view of the sub drum and a sub drum spider of FIG. 6.

FIGS. 6 and 7 are a front view and a rear view of a sub drum 60, respectively according to an embodiment of the present invention, the sub drum 60 formed as the cylindrical portion and the sub drum back are assembled with each other. Referring to FIGS. 6 and 7, the cylindrical portion 61 and the sub drum back 62 of the sub drum 60 are configured as independent members. The sub drum back 62 is coupled to an outer circumference of the rear of the cylindrical portion 61, thereby closing the rear side opening of the cylindrical portion 61.

Referring to FIG. 7, for assembly of the sub drum 60, the cylindrical portion 61 includes sub drum back coupling holes 61*aa* formed at a rear end thereof. And the sub drum back 62 includes a bending portion 62*a* formed as an outer circumference of the sub drum back 62 is bent in a lengthwise direction of the sub drum 60, and cylindrical portion coupling holes 62*aa* formed at the bending portion 62*a*. The sub drum spider 95 is provided with coupling holes 98 corresponding to the cylindrical portion coupling holes 62*aa*. Referring to FIG. 7, the coupling holes 98 are formed on the end portion The sub drum 60 in this embodiment may be implemented as the sub drum back coupling holes 61*aa* and the cylindrical portion coupling holes 62*aa* are coupled to each other via coupling bolts, etc. in an aligned state.

An accommodation portion 63 of the sub drum back 62 may be extending up to an outer circumference of the sub drum back 62. A plurality of cantilevers 97 of a sub drum fixing portion provided at the sub drum spider 95 may be extending up to an outer circumference of the sub drum back 62, from the inner shaft 82 in a radial direction. Referring to FIG. 7, the coupling holes 98 are formed at the end portion of each cantilever 97 in a radial direction. Each end of the cantilevers 97 is coupled to the sub drum back 62 on the outer circumference of the rear surface of the cylindrical portion 61. Preferably, as shown in FIG. 7, each end of the cantilevers 97 is coupled to the sub drum back 62 on the bending portion 62*a* of the sub drum back 62, via coupling bolts which sequentially pass through the coupling holes 61*aa*, 62*aa* and 98.

When compared with a sub drum 60' according to another embodiment of the present invention to be explained later, the sub drum 60 according to one embodiment of FIGS. 6 and 7 can increase an inner capacity thereof, because a connection part between the cylindrical portion 61 and the outer circumference of the sub drum back 62 needs not to be bent. For instance, the sub drum 60 according to this embodiment can obtain an inner capacity of about 94 L.

In this embodiment, the cylindrical portion 61 and the sub drum back 62 are assembled to each other to implement the sub drum 60. Dehydration holes, patterns, etc. are formed at each member before assembly processes. Accordingly, in the sub drum according to this embodiment, an operation to process dehydration holes, patterns, etc. is facilitated.

However, in this embodiment, the sub drum 60 is implemented as independent members are assembled to each other. This may cause a bonding intensity of the members to be weaker than that of an integrated type sub drum 60'.

An assembly method of the washing machine including the sub drum 60 of FIGS. 6 and 7 according to one embodiment will be explained.

An assembly method of the washing machine according to one embodiment of the present invention comprises: forming a rear surface of the sub drum; and coupling the sub drum spider 95 to the rear surface of the sub drum.

The step of forming the rear surface of the sub drum includes closing a rear side opening of the cylindrical portion 61 with the sub drum back 62.

The step of coupling the sub drum spider 95 to the sub drum 60 includes: accommodating the sub drum spider 95 into the accommodation portion 63 forward-concaved from the sub drum back 62; and coupling each end of cantilevers 97 of the sub drum spider 95 to the sub drum back 62 via bolts.

In the step of coupling each end of cantilevers 97 of the sub drum spider 95 to the sub drum back 62 via bolts, the coupling may be performed through the coupling holes 61*aa* formed at a rear end of the cylindrical portion 61 of the sub drum 60, the coupling holes 62*aa* formed at the bending portion 62*a* of the sub drum back 62, and coupling holes 98 formed at the end portion of each cantilevers 97.

Figure 8:
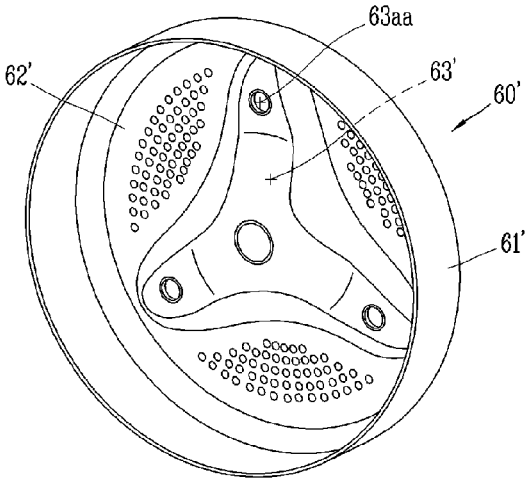
FIG. 8 is a front perspective view of a sub drum according to another embodiment of the present invention.
Figure 9:
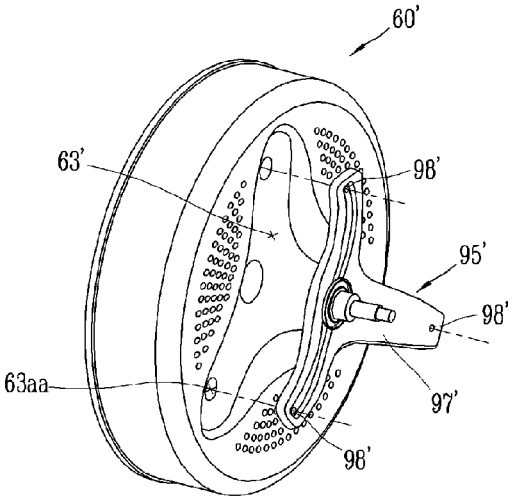
FIG. 9 is a rear exploded perspective view of the sub drum and a sub drum spider of FIG. 8.

FIG. 8 and FIG. 9 are a front view and a rear view of a sub drum 60' according to another embodiment of the present invention, the sub drum 60' formed as the cylindrical portion and the sub drum back have been integrated with each other. Referring to FIGS. 8 and 9, the sub drum 60' is a single member where the cylindrical portion 61' and the sub drum back 62' have been integrated with each other.

In a case where the sub drum 60' is configured as a single member, the intensity of the member can be enhanced, and the durability can be enhanced due to no additional coupling operation. Further, roundness of the sub drum can be enhanced.

In this embodiment, the sub drum 60' should be formed as a single member. For this, as shown in FIG. 9, a connection part between the cylindrical portion 61' and an outer circumference of the sub drum back 62' is formed to be curved. Under such configuration, an inner space of the sub drum 60' has a capacity a little smaller than that of the aforementioned sub drum 60, due to the curved part. For instance, the washing machine may be designed so that an inner capacity of the drum can be about 90 L. Further, since the sub drum 60' is configured as a single member in this embodiment, it is more difficult to process dehydration holes, patterns, etc. than in the aforementioned sub drum 60.

Referring to FIG. 9, the accommodation portion 63' is provided with spider coupling holes 63*aa* for coupling the sub drum spider 95' thereto, and the sub drum spider 95' is provided with coupling holes 98 corresponding to the spider coupling holes 63*aa*. The coupling holes 63*aa* may be disposed adjacent to an end of the accommodation portion in a radial direction.

The accommodation portion 63' is configured to accommodate therein the sub drum spider 95' having a plurality of cantilevers 97' in a radial direction, so that a rotational force of the sub drum spider 95' can be transmitted to the sub drum 60'.

The sub drum spider 95', which has been accommodated in the accommodation portion 63', is stably coupled to the sub drum back 62' by coupling bolts, etc. For this, the spider coupling holes 63*aa* are formed at the accommodation portion 63', and coupling holes 98' are provided at the sub drum spider 95'.

Referring to FIG. 9, the accommodation portion 63' is formed at an inner side of the outer circumference of the sub drum back 62', and the outer circumference of the sub drum back 62' is spaced from the end of the accommodation portion 63' in a radial direction. Preferably, the cantilevers 97' of the sub drum spider 95' are formed so that a length thereof can be smaller than a radius of the sub drum back 62' so as to be accommodated in the accommodation portion 63'.

The invention claimed is:

1. A washing machine having a dual-drum, comprising:
- a cabinet which forms an appearance of the washing machine;
- a tub provided in the cabinet;
- a main drum rotatably mounted in the tub;
- a sub drum mounted in the main drum to be relatively rotatable with respect to the main drum;
- an outer shaft for rotating the main drum;
- an inner shaft for rotating the sub drum, being disposed inside the outer shaft;
- a main drum spider configured to connect the main drum and the outer shaft to each other;
- a sub drum spider configured to connect the sub drum and the inner shaft to each other; and
- a driving motor,
- wherein the driving motor comprises:
  - a stator having a ring shape;
  - an outer rotor connected to the inner shaft, and rotated outside the stator; and
  - an inner rotor connected to the outer shaft, and rotated inside the stator,
  - wherein the stator is provided with an inner winding portion and an outer winding portion, and
  - wherein the inner rotor and the outer rotor are rotated in an independent manner when a current flowing to coils wound on the inner winding portion and the outer winding portion of the driving motor is controlled.

2. The washing machine of claim 1, wherein the sub drum comprises:
- a cylindrical portion which forms an outer circumferential surface of the sub drum; and
- a sub drum back which forms a rear surface of the sub drum, and to which the sub drum spider is coupled,
- wherein the sub drum back comprises an accommodation portion forward-concaved from the sub drum back and configured to accommodate the sub drum spider at a rear side thereof, and
- wherein the sub drum spider is provided with a plurality of cantilevers radially extending from the inner shaft, and is coupled to the sub drum back.

3. The washing machine of claim 2, wherein the sub drum is a single member where the cylindrical portion and the sub drum back have been integrated with each other.

4. The washing machine of claim 3, wherein the accommodation portion is provided with coupling holes for coupling the sub drum spider thereto, and
- wherein the coupling holes are formed at an end portion of the accommodation portion in a radial direction.

5. The washing machine of claim 4, wherein the sub drum spider is provided with coupling holes corresponding to the coupling holes of the accommodation portion.

6. The washing machine of claim 3, wherein the cantilevers of the sub drum spider are formed such that a length thereof is smaller than a radius of the sub drum back so as to be accommodated in the accommodation portion.

7. The washing machine of claim 6, wherein the accommodation portion is formed at an inner side of the sub drum back by being spaced from an outer circumference of the sub drum back.

8. The washing machine of claim 2, wherein the cylindrical portion and the sub drum back of the sub drum are configured as independent members.

9. The washing machine of claim 8, wherein the sub drum back is coupled to an outer circumference of a rear of the cylindrical portion, to thus close the rear side of the cylindrical portion.

10. The washing machine of claim 8, wherein the accommodation portion of the sub drum back is extendable up to an outer circumference of the sub drum back.

11. The washing machine of claim 10, wherein the cylindrical portion comprises sub drum back coupling holes formed at a rear end of the cylindrical portion, and coupled to the sub drum back; and wherein the sub drum back further comprises:

a bending portion formed as an outer circumference of the sub drum back is bent in a lengthwise direction of the sub drum; and cylindrical portion coupling holes formed at the bending portion.

12. The washing machine of claim 10, wherein the sub drum spider is formed such that its cantilevers are extendable up to an outer circumference of the sub drum back, and wherein each end of the cantilevers of the sub drum spider is coupled to the sub drum back on an outer circumference of a rear of the cylindrical portion.

13. The washing machine of claim 1, wherein the inner rotor and the outer rotor are provided with a magnet, respectively.

* * * * *